US010453438B1

(12) United States Patent
Griffin et al.

(10) Patent No.: US 10,453,438 B1
(45) Date of Patent: Oct. 22, 2019

(54) METHODS AND SYSTEMS FOR BROAD-BAND ACTIVE NOISE REDUCTION

(71) Applicant: The Boeing Company, Chicago, IL (US)

(72) Inventors: Steven F. Griffin, Kihei, HI (US); Adam R. Weston, Brier, WA (US); Mark M. Gmerek, Clinton, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/992,671

(22) Filed: May 30, 2018

(51) Int. Cl.

| | |
|---|---|
| ***G10K 11/16*** | (2006.01) |
| ***G10K 11/178*** | (2006.01) |
| ***H04R 1/02*** | (2006.01) |
| ***G10K 11/172*** | (2006.01) |
| *H04R 5/02* | (2006.01) |

(52) U.S. Cl.
CPC ..... *G10K 11/17823* (2018.01); *G10K 11/172* (2013.01); *H04R 1/025* (2013.01); *G10K 2210/1281* (2013.01); *G10K 2210/3026* (2013.01); *G10K 2210/3044* (2013.01); *G10K 2210/3056* (2013.01); *G10K 2210/3221* (2013.01)

(58) Field of Classification Search
CPC ..... G10K 2210/1281; G10K 11/172; G10K 11/17823; H04R 1/025
USPC ..... 381/71.4, 338, 301
See application file for complete search history.

(56) References Cited

U.S. PATENT DOCUMENTS

2002/0061114 A1* 5/2002 Croft, III ..... H04R 1/2842 381/345
2005/0094829 A1* 5/2005 Cordell ..... H04R 3/08 381/103
2016/0257227 A1* 9/2016 Takada ..... B60R 11/0217
2018/0266301 A1* 9/2018 Higashino ..... F01N 1/023

OTHER PUBLICATIONS

"EP3 Sonic Defenders & EP4 Sonic Defenders Plus", Surefire Product Information Sheet, Jun. 2005, 1 pg.

* cited by examiner

*Primary Examiner* — Xu Mei
*Assistant Examiner* — Ammar T Hamid
(74) *Attorney, Agent, or Firm* — Kwan & Olynick LLP

(57) ABSTRACT

Described are methods and systems for broad-band active reduction of noise in target spaces, such as spaces around headrests in aircraft cabins. Systems describe herein are effective over wide frequency ranges without causing undesirable amplification at any subrange ranges. Specifically, a system comprises a speaker and a resonator, both coupled to an enclosure. The interior space of the resonator is in fluid communication with the enclosed space of the enclosure, allowing the resonator to reduce the amplitude of unwanted amplification by the audio reducing sound generated by the speaker. The amplitude is reduced in a selected frequency range, which may correspond to an expected amplification for this particular system. The resonator may partially extend into the enclosure or may be completely incorporated into the enclosure. Some examples of the resonator include a Helmholtz resonator, a passive radiator, a quarter wave resonator, a pipe resonator, and an acoustic metamaterial.

20 Claims, 17 Drawing Sheets

Figure 6 – Transfer functions with and without feedback

Figure 10 – Closed-loop behavior with Helmholtz resonator

METHODS AND SYSTEMS FOR BROAD-BAND ACTIVE NOISE REDUCTION

BACKGROUND

Various noise cancellation and reduction techniques, both active and passive, have been used to reduce unwanted ambient sounds. For example, an active system includes a speaker producing sound with the same amplitude but with the opposite polarity to the ambient sound. The system is designed such that the ambient and generated waves cancel each other thereby producing noise cancellation. However, active noise cancellation in free space has been challenging and generally limited to narrow frequency ranges. Furthermore, active noise reduction using conventional feedback methods tends to cause amplification of the noise at other frequencies. What is needed are methods and system for broad-band active noise cancellation.

SUMMARY

Described are methods and systems for broad-band active reduction of noise in target spaces, such as spaces around headrests in aircraft cabins. Systems describe herein are effective over wide frequency ranges without causing undesirable amplification at any subrange ranges. Specifically, a system comprises a speaker and a resonator, both coupled to an enclosure. The interior space of the resonator is in fluid communication with the enclosed space of the enclosure, allowing the resonator to reduce the amplitude of the audio reducing sound generated by the speaker. The amplitude is reduced in a selected frequency range, which may correspond to an expected amplification for this particular system. The resonator may partially extend into the enclosure or may be completely incorporated into the enclosure. Some examples of the resonator include a Helmholtz resonator, a passive radiator, a quarter wave resonator, a pipe resonator, and an acoustic metamaterial.

Illustrative, non-exclusive examples of inventive features according to present disclosure are described in following enumerated paragraphs:

Illustrative, non-exclusive examples of inventive features according to present disclosure are described in following enumerated paragraphs:

A1. Method 300 for broad-band reduction of noise in target space 290, method 300 comprising:

- generating microphone signal 211, wherein microphone signal 211 represents noise in target space 290 and is generated using feedback microphone 210;
- transmitting microphone signal 211 to system controller 220;
- generating speaker signal 221 based on microphone signal 211, wherein speaker signal 221 is generated using system controller 220;
- transmitting speaker signal 221 to speaker 230, wherein speaker 230 partially extends into an enclosure 240, and wherein rear side 232 of speaker 230 forms enclosed space 242 together with enclosure 240;
- generating audio reducing sound 231 in target space 290, wherein audio reducing sound 231 is generated using speaker 230 and based on speaker signal 221; and
- reducing amplitude of unwanted amplification due to audio reducing sound 231 in a selected frequency range using resonator 250, wherein resonator 250 is in fluid communication with enclosed space 242.

A2. Method 300 of paragraph A1, wherein, while reducing amplitude of audio reducing sound 231, air flows between resonator 250 and enclosed space 242.

A3. Method 300 of any one of paragraphs A1-A2, wherein resonator 250 at least partially extends into enclosed space 242.

A4. Method 300 of any one of paragraphs A1-A3, wherein resonator 250 comprises neck 254, extending into enclosed space 242.

A5. Method 300 of any one of paragraphs A1-A2, wherein resonator 250 is selected from the group consisting of a Helmholtz resonator, a passive radiator, a quarter wave resonator, a pipe resonator, and an acoustic metamaterial.

A6. Method 300 of any one of paragraphs A1-A5, wherein selected frequency range muted using resonator 250 is above 100 Hz.

A7. Method 300 of any one of paragraphs A1-A6, further comprising reducing amplitude of audio reducing sound 231 in an additional selected frequency range using additional resonator 255, wherein additional resonator 280 in fluid communication with enclosed space 242, wherein additional selected frequency range is different from selected frequency range.

A8. Method 300 of any one of paragraphs A1-A7, further comprising changing selected frequency range by changing one of more characteristics of resonator.

A9. Method 300 of paragraph A8, wherein changing one of more characteristics of resonator 250 comprises changing the volume of interior space 252 of resonator 250 or changing an area of an opening to interior space 252 of resonator 250.

A10. Method 300 of any one of paragraphs A1-A9, wherein target space 290 is an area surrounding headrest 507 of passenger seat 505 in an aircraft, and feedback microphone 210, speaker 230, and enclosure 240 are disposed in headrest 507 of passenger seat 505.

B1. System 200 for broad-band reduction of noise in target space 290, system 200 comprising:

- feedback microphone 210, configured to generate microphone signal 211 representing noise in target space 290;
- system controller 220, coupled to feedback microphone 210, configured to receive microphone signal 211 representing from feedback microphone 210 and configured to generate speaker signal 221 based on microphone signal 211;
- speaker 230, comprising rear side 232 and configured to generate audio reducing sound 231 in target space 290 based on speaker signal 221;
- enclosure 240, wherein speaker 230 partially extends into enclosure 240, and wherein rear side 232 of speaker 230 forms enclosed space 242 together with enclosure 240; and
- resonator 250, in fluid communication with enclosed space 242, wherein resonator 250 is configured to reduce amplitude of audio reducing sound 231 in a selected frequency range.

B2. System 200 of paragraph B1, wherein resonator 250 is selected from group consisting of a Helmholtz resonator, a passive radiator, a quarter wave resonator, a pipe resonator, and an acoustic metamaterial.

B3. System 200 of any one of paragraphs B1-B2, wherein resonator 250 at least partially extends into enclosed space 242.

B4. System 200 of any one of paragraphs B1-B3, wherein resonator 250 comprises neck 254, extending into enclosed space 242.

B5. System 200 of any one of paragraphs B1-B4, wherein resonator 250 is fully within enclosed space 242.

B6. System 200 of any one of paragraphs B1-B5, wherein resonator 250 is a part of enclosure 240.

B7. System 200 of any one of paragraphs B1-B6, wherein resonator 250 comprises interior space 252, comprising an opening, wherein the volume of interior space 252 or an area of opening to interior space 252 of resonator 250 is controllably adjustable.

B8. System 200 of any one of paragraphs B1-B7, further comprising additional resonator 280, in fluid communication with enclosed space 242, wherein additional resonator 280 is configured to reduce amplitude of audio reducing sound 231 in an additional selected frequency range, different from selected frequency range.

B9. System 200 of any one of paragraphs B1-B2, further comprising headrest 507 for use in a passenger seat of an aircraft, wherein feedback microphone 210, speaker 230, and enclosure 240 are disposed in headrest 507 of passenger seat 505.

C1. Aircraft 500 comprising:

passenger seat 505, comprising headrest 507; and system 200, comprising:

- feedback microphone 210, configured to generate microphone signal 211 representing noise in target space 290;
- system controller 220, coupled to feedback microphone 210, configured to receive microphone signal 211 representing from feedback microphone 210 and configured to generate speaker signal 221 based on microphone signal 211;
- speaker 230, comprising rear side 232 and configured to generate audio reducing sound 231 in target space 290 based on speaker signal 221;
- enclosure 240, wherein speaker 230 partially extends into enclosure 240, and wherein rear side 232 of speaker 230 forms enclosed space 242 together with enclosure 240; and
- resonator 250, in fluid communication with enclosed space 242, wherein resonator 250 is configured to reduce amplitude of audio reducing sound 231 in a selected frequency range,
- wherein feedback microphone 210, speaker 230, and enclosure 240 are disposed in headrest 507 of passenger seat 505.

These and other embodiments are described further below with reference to figures.

BRIEF DESCRIPTION OF THE DRAWINGS

The disclosure may best be understood by reference to the following description taken in conjunction with the accompanying drawings, which illustrate various embodiments of the disclosure.

DETAILED DESCRIPTION

In the following description, numerous specific details are set forth in order to provide a thorough understanding of the presented concepts. The presented concepts may be practiced without some, or all, of these specific details. In other instances, well known process operations have not been described in detail to not unnecessarily obscure the described concepts. While some concepts will be described with the specific embodiments, it will be understood that these embodiments are not intended to be limiting.

INTRODUCTION

Figure 1A:
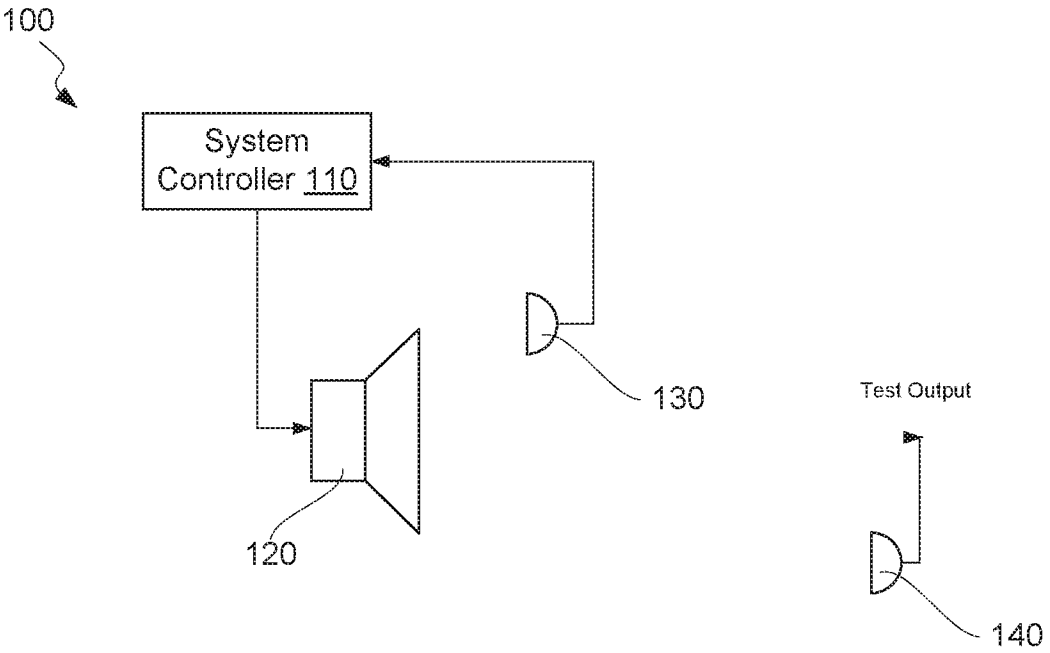
FIG. 1A is a schematic illustration of an acoustic control system, which an example of an active feedback control system.

Active noise control has been primarily used in headphones where speakers can positioned at controlled distances to users' ears. Expanding active noise control to free space applications has been limited because of less control, which may cause amplification rather than reduction of sound at certain frequencies and certain conditions as will now be described with reference to FIGS. 1A and 1B. Specifically, FIG. 1A is a schematic illustration of acoustic control system 100, which is typically used for active noise reduction using feedback control. Acoustic control system 100 comprises microphone 130, system controller 110, and speaker 120. During its operation, acoustic control system 100 monitors ambient sound using microphone 130 and outputs a sound wave to reduce the sound at both microphones using speaker 120. System controller 110 comprises various circuit components, such as amplifiers and notch filters, to yield a signal that reduces sound.

Figure 1B:
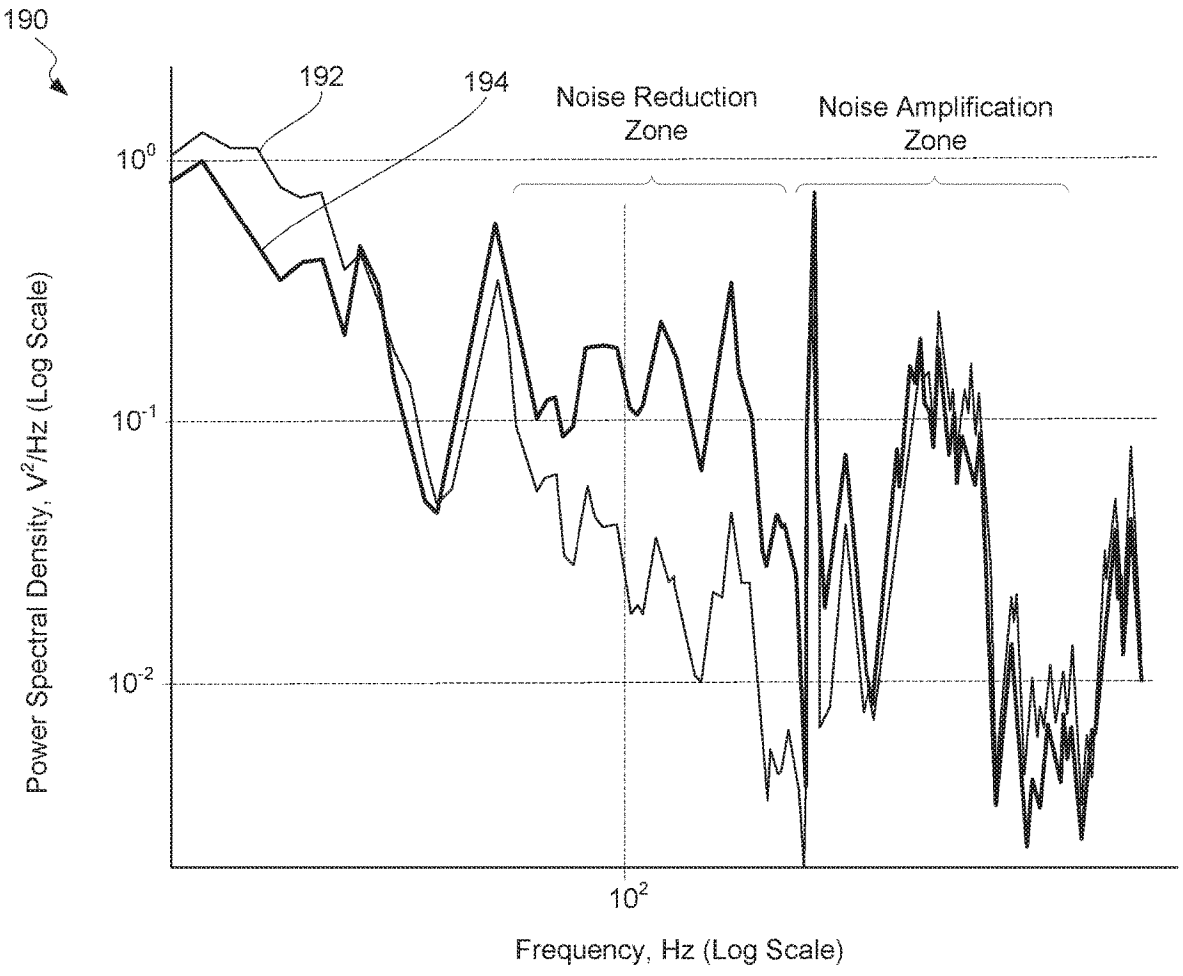
FIG. 1B shows a plot representing performance of the acoustic control system in FIG. 1A.

FIG. 1A also illustrates test microphone 140 for capturing performance of acoustic control system 100. Unlike microphone 130, test microphone 140 is a not a part of acoustic control system 100. The position of test microphone 140 may correspond, for example, to an expected position of a person's ear. FIG. 1B shows plot 190 representing performance of acoustic control system 100, measures using test microphone 140. Plot 190 includes closed loop response 192, when the control system is turned on, and open loop response 194, when the control system is off. Comparing closed loop response 192 and open loop response 194, the noise has been effectively reduced up to around 300 Hz using acoustic control system 100 operating with the closed loop. However, above 300 Hz, the noise has been amplified during this operation. The frequency, at which the active control system transitions from reducing noise to amplifying noise, is related to the distance between microphone 130 and speaker 120 and could be different for different systems.

Furthermore, when A-weighting is taken into account to estimate human perception of the results shown in FIG. 1B, the results show that very little, if any, noise reduction has been achieved with acoustic control system 100.

Examples of System for Broad-Band Reduction of Noise in Target Space

Figure 2A:
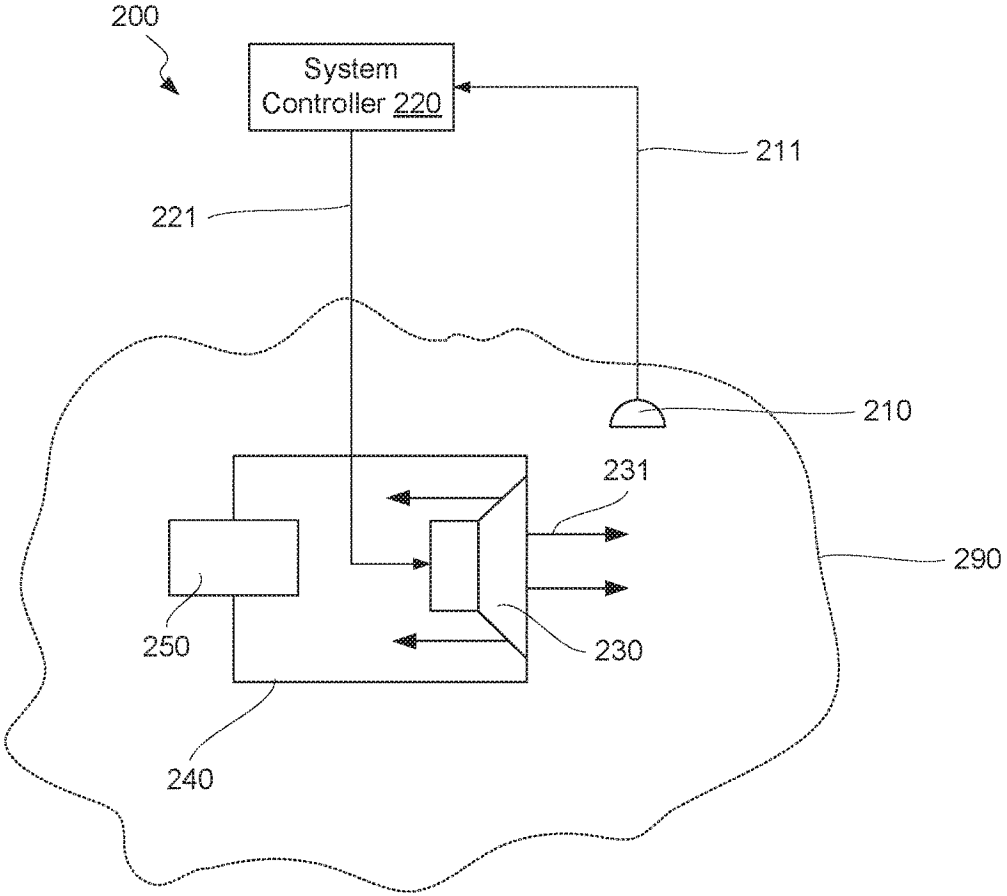
FIG. 2A is a schematic illustration of a system for broad-band active noise reduction in a target space, in accordance with some embodiments.

FIG. 2A is a schematic illustration of system 200 for broad-band active noise reduction in target space 290, in accordance with some embodiments. System 200 is configured to decrease the amplification in a selected frequency range by adding resonator 250, which may have an effect similar to a lead/lag filter found in a feedback control. However, resonator 250 provides actual (physical) reduction of the amplitude of the produced audio reducing sound rather than a specific configuration of a feedback signal. This reduction can be tuned to the frequency range beyond where noise cancellation occurs for the purpose of mitigating undesirable amplification. Overall, system 200 comprises feedback microphone 210, system controller 220, speaker 230, enclosure 240, and resonator 250. In some embodiments, system 200 comprises additional resonator 280 to decrease the amplification in an additional frequency range. Some resonator designs such as quarter wave resonator or acoustic metamaterial may be employed to minimize the size of system 200. An acoustic metamaterial is a collection of unit cells, each tuned to a given resonant frequency. The dimensions of the unit cells are a fraction of the wavelength of the resonant frequency in air. As an absorber, the resonant frequency can tuned to affect the frequency range where amplification would otherwise occur. The compact size of the acoustic metamaterial can be a means to minimize the size of the active noise control system.

Feedback microphone 210 is configured to generate microphone signal 211, which may correspond to sound in target space 290. Feedback microphone 210 is positioned outside of enclosure 240 and may be oriented toward speaker 230 as, for example, shown in FIG. 2A. In some embodiments, further described below, feedback microphone 210 is positioned in a headrest of a passenger seat.

System controller 220 is configured to receive microphone signal 211 from feedback microphone 210, to which system controller 220 is coupled. System controller 220 is also configured to generate speaker signal 221 based on microphone signal 211. System controller 220 then transmits generate speaker signal 221 to speaker 230, to which system controller 220 is coupled. Speaker signal 221 is generated from a feedback controller with the control objective to minimize noise.

Speaker 230 is configured to receive speaker signal 221 from system controller 220 and also configured to generate audio reducing sound 231 in target space 290. Audio reducing sound 231 is generated based on speaker signal 221. Speaker 230 comprises rear side 232, which may extend into enclosure 240.

Enclosure 240 may be used to house speaker 230. For example, speaker 230 partially extends into enclosure 240. In some embodiments, rear side 232 of speaker 230 forms enclosed space 242 together with enclosure 240.

Resonator 250 is configured to reduce the amplitude of audio reducing sound 231 that is amplifying in a selected frequency range. For purposes of this disclosure, the amplitude reduction may be referred to as muting. Specifically, resonator 250 comprises interior space 252, which is in fluid communication with enclosed space 242. The volume of interior space 252 and other characteristics of resonator 250 may be selected to achieve muting in the desired frequency range. The muting is achieved through coupling because of springiness of air within interior space 252, e.g., compressing and expanding the air within interior space 252.

Some examples of resonator 250 include, but are not limited to, a Helmholtz resonator, a passive radiator, a quarter wave resonator, a pipe resonator, and an acoustic metamaterial. A Helmholtz resonator comprises interior space 252 and neck 254, as for example, shown in FIG. 2B. Neck 254 extends to interior space 252 and providing fluid communication between interior space 252 and enclosed space 242 of enclosure 240. The resonant frequency of a Helmholtz resonator is determined by the volume of interior space 252, cross-sectional area of the opening in neck 254, as well as the length of neck 254. In some embodiments, the volume, cross-sectional area, and/or length are adjustable, which allows changing the resonant frequency of the Helmholtz resonator.

A passive radiator may have a similar design to speaker 230 but have not voice coil and/or magnet assembly. A passive radiator may uses audio reducing sound 231, otherwise trapped in enclosure 240, to excite a resonance. A pipe resonator may be configured in a manner of a pipe side branch with dimensions determined to produce an acoustic resonance at a desired frequency. A pipe resonator may be a cylindrical side branch resonator, which is approximately one-quarter wavelength deep. Alternatively, a pipe resonator is an acoustic metamaterial resonator, which is a fraction of a wavelength deep, can reduce the overall size of the resonator enclosure.

Figure 2D:
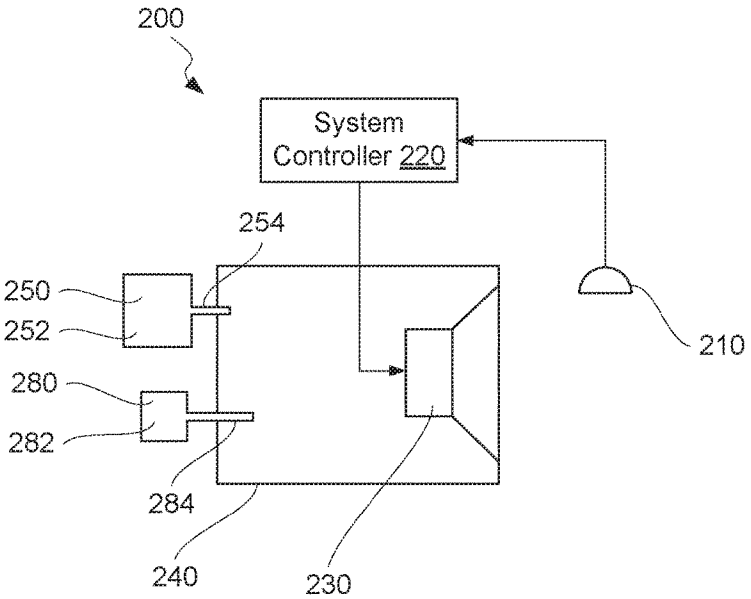
FIGS. 2B-2D are schematic illustrations of different examples of the system for broad-band active noise reduction.
Figure 2B:
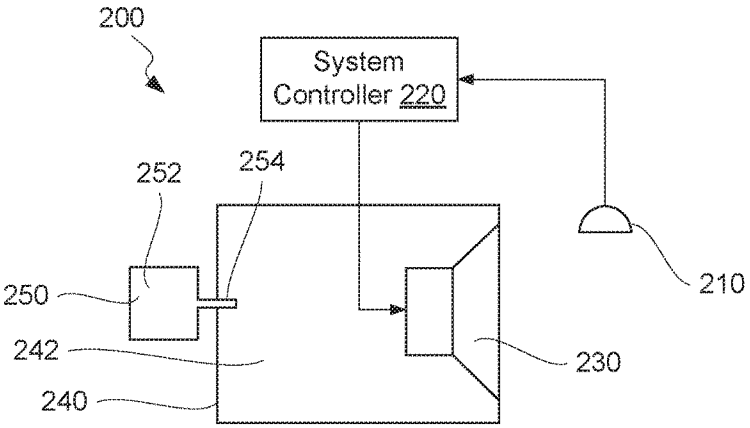

In some embodiments, resonator 250 at least partially extends into enclosed space 242 as, for example, shown in FIG. 2B. For example, resonator 250 may comprise neck 254, extending into enclosed space 242, allowing air to flow between enclosed space 242 of enclosure 240 and interior space 252 of resonator 250. The rest of resonator 250 may be positioned outside of enclosed space 242. This example allows reducing the overall size of resonator 250 and enclosure 240.

Figure 2C:
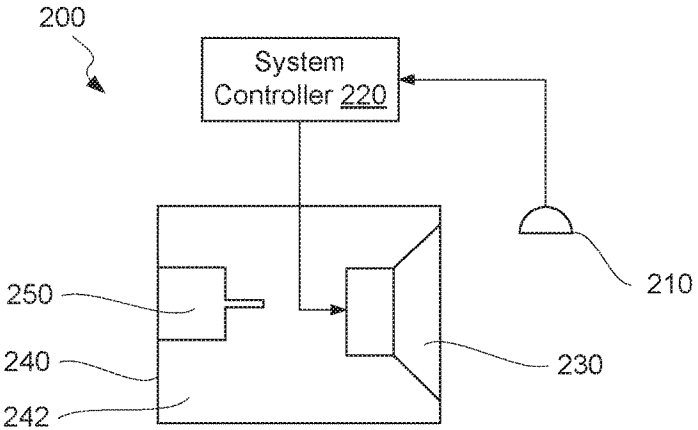

In some embodiments, resonator 250 is fully within enclosure 240 as, for example, shown in FIG. 2C. In these embodiments, enclosed space 242 of enclosure 240 is still separated from interior space 252 of resonator 250 by neck 254, which provides fluid communication between enclosed space 242 and interior space 252. This design is compact and may be particular useful for small spaces, such as headrests of passenger seats of aircraft.

In some embodiments, resonator 250 may be a part of enclosure 240. In these embodiments, walls of resonator 250 may monolithic with walls of enclosure 240. For example, resonator 250 and enclosure 240 may be formed during the same injection molding or additive manufacturing process.

In some embodiments, system 200 comprises additional resonator 280 as, for example, shown in FIG. 2D. Additional resonator 280 comprises additional interior space 282, which is also in fluid communication with enclosed space 242, similar to interior space 252 or resonator 250. Additional resonator 280 is configured to reduce the amplitude of audio reducing sound 231 in an additional selected frequency range where it is amplifying, which is different from the selected frequency range. The frequency range difference may be achieved with different designs of the two resonators. In general, system 200 may have any number of resonators, each designed for muting a specific frequency range of audio reducing sound 231 with enclosed space 242.

In some embodiments, the volume of interior space 252 of resonator 250, the area of the opening to interior space 252 of resonator 250, and/or some other characteristic of resonator 250 is controllably adjustable. This adjustment may be used to change the selected frequency range. The adjustment may be automatic, e.g., in response to a signal from system controller 220 or manual (e.g., by a use of system 200).

Figure 2E:
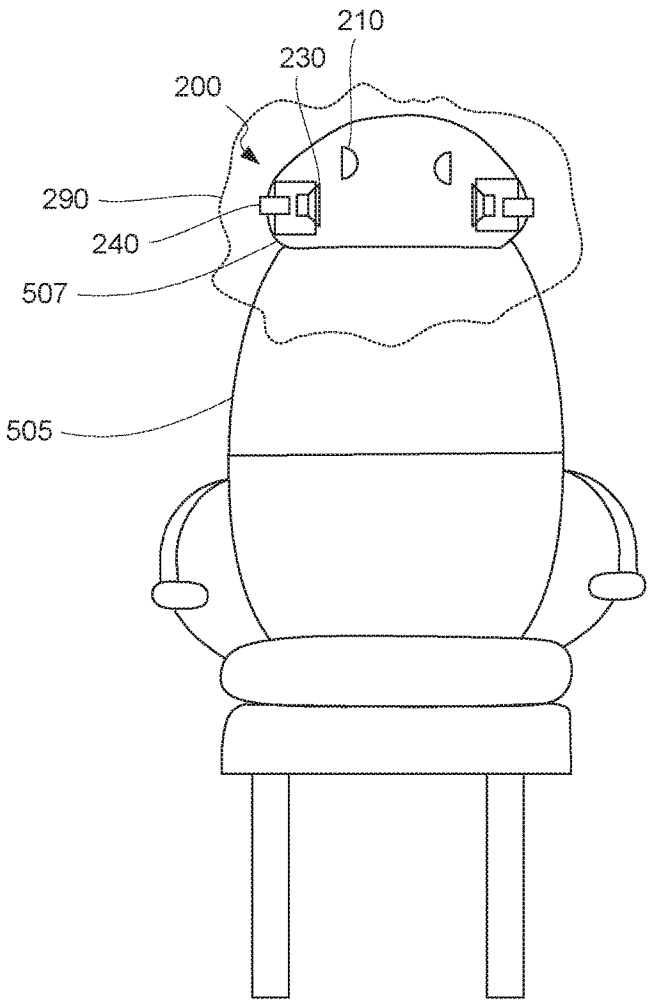
FIG. 2E is a schematic illustration a system for broad-band active noise reduction, comprising a headrest, in accordance with some embodiments.
Figure 2F:
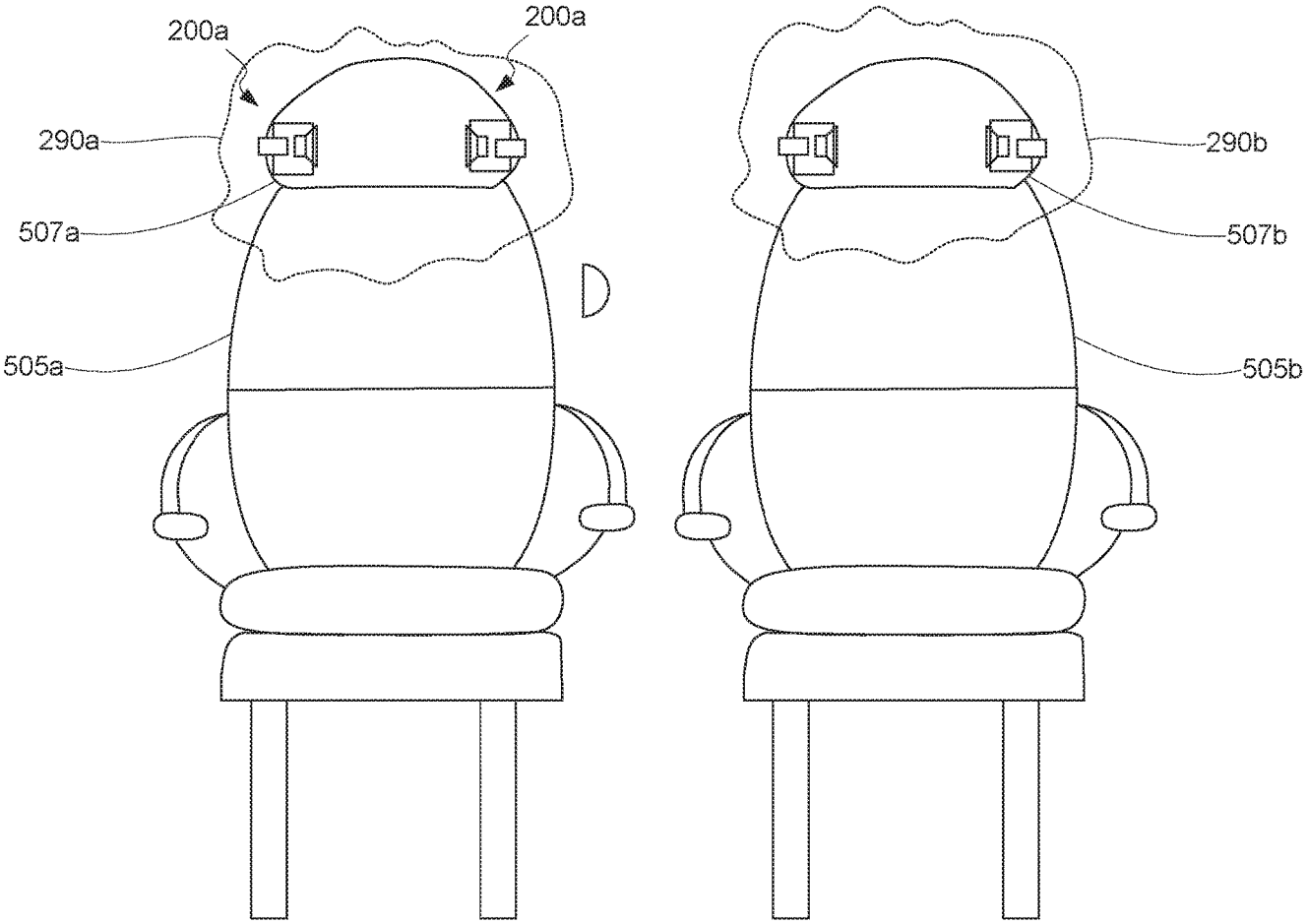
FIG. 2F is a schematic illustration two systems for broad-band active noise reduction, showing respective target spaces of both systems, in accordance with some embodiments.
Figure 2G:
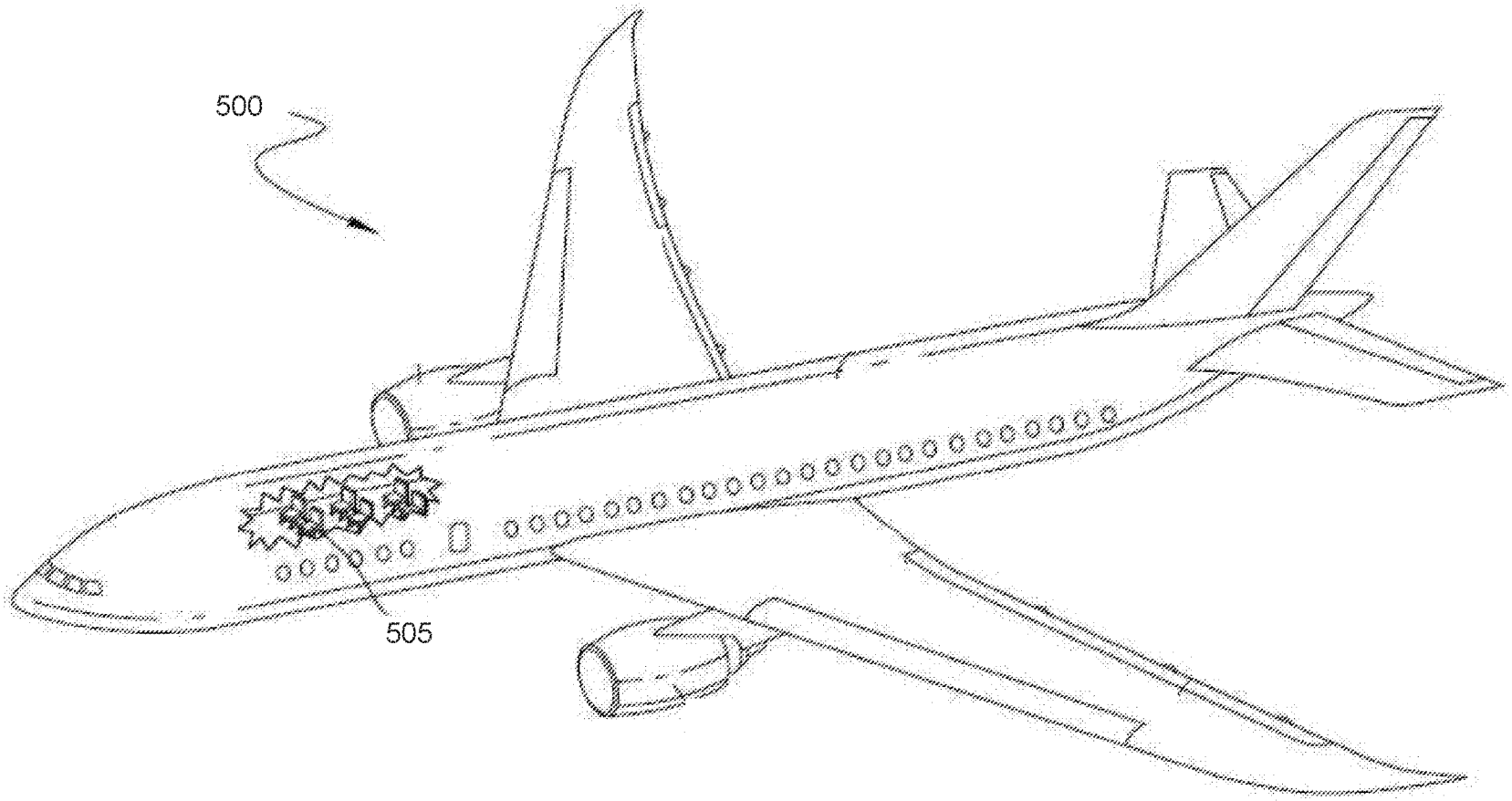
FIG. 2G is a schematic illustration an airplane, comprising one or more systems for broad-band active noise reduction, in accordance with some embodiments.

In some embodiments, system 200 further comprises headrest 507 for use in passenger seat 505 of aircraft 500, as for example, shown in FIGS. 2E-2G. In these embodiments, feedback microphone 210, speaker 230, and enclosure 240 are disposed in headrest 507 of passenger seat 505. FIG. 2E also illustrates another set of feedback microphone, speaker, and enclosure disposed in the same headrest 507 and being a part of system 200. Both sets operate in the same target space 290.

Also provided is aircraft 500, comprising passenger seat 505 or, more specifically, multiple passenger seats as, for example, shown in FIG. 2G. Referring to FIGS. 2E and 2F, each passenger seat 505 comprises headrest 507 and system 200 for broad-band reduction of noise in target space 290. Various examples and features of system 200 are described above. Each system 200 may have its own target space 290 corresponding to this specific passenger seat as, for example, shown in FIG. 2F.

Examples of Method for Broad-Band Reduction of Noise in Target Space

Figure 3:
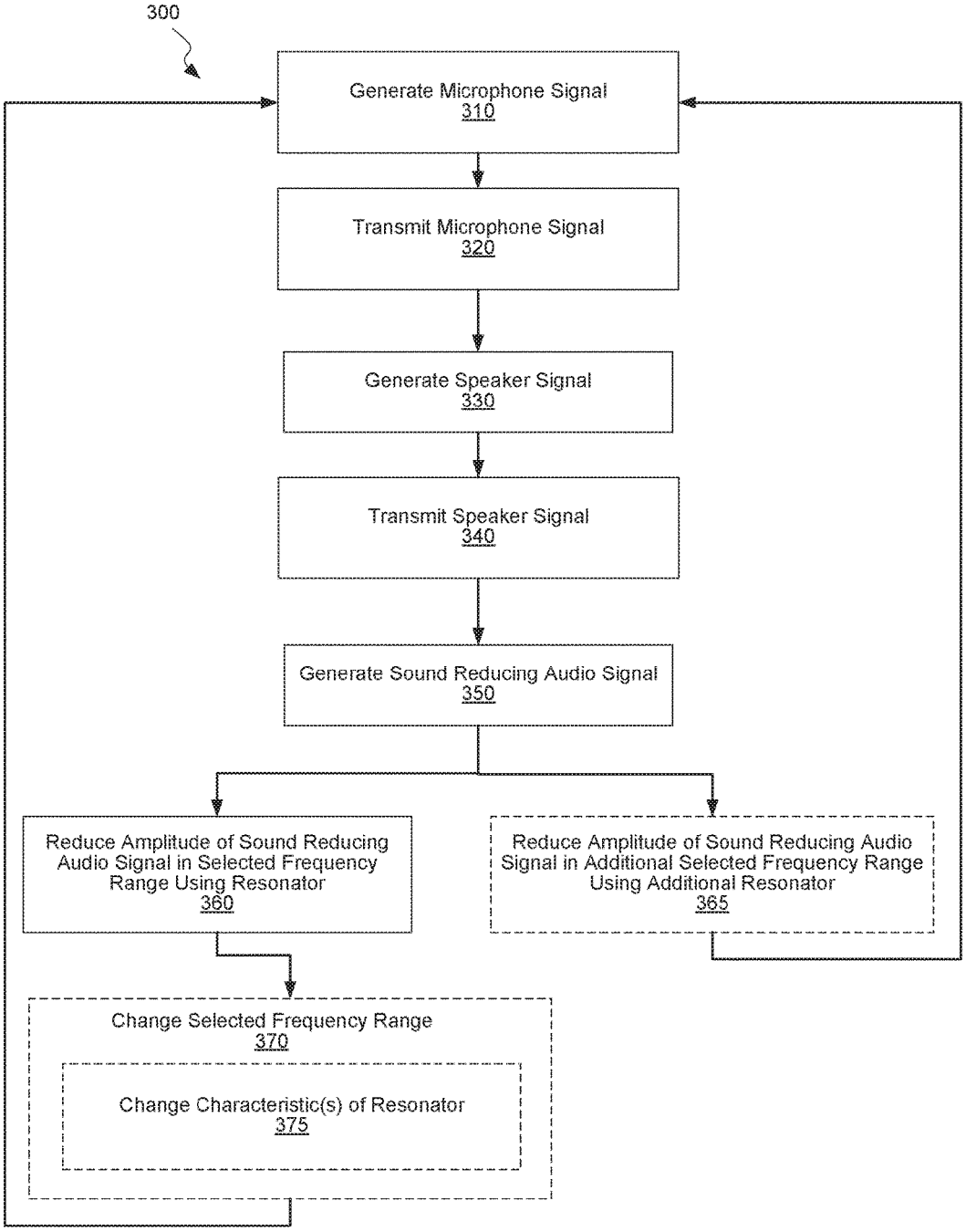
FIG. 3 is a process flowchart corresponding to a method for broad-band active noise reduction, in accordance with some embodiments.

FIG. 3 is a process flowchart corresponding to method 300 for broad-band reduction of noise in target space 290, in accordance with some embodiments. Various operations of method 300 may be executed using system 200 described above. In general, system 200 comprises feedback microphone 210, system controller 220, speaker 230, enclosure 240, and resonator 250.

Referring to block 310 in FIG. 3, method 300 may commence with generating microphone signal 211. Microphone signal 211 represents noise in target space 290 and is generated using feedback microphone 210.

Referring to block 320 in FIG. 3, method 300 may proceed with transmitting microphone signal 211 to system controller 220. As described above, feedback microphone 210 is coupled to system controller 220 (e.g., using wires or wirelessly) and configured to transmit all generated microphone signals to system controller 220. The process of generating and transmitting microphone signal 211 is continuous.

Referring to block 330 in FIG. 3, method 300 may proceed with generating speaker signal 221 based on microphone signal 211, wherein speaker signal 221 is generated using system controller 220. Specifically, speaker signal 221 is generated using feedback. Unlike conventional noise cancellation system, system 200 benefits from additional gain on system controller 220 by incorporating resonator 250. This additional gain is achieved without as much unwanted amplification and provides improved low frequency performance, in comparison with conventional active noise cancellation systems.

Referring to block 340 in FIG. 3, method 300 may proceed with transmitting speaker signal 221 to speaker 230. As described above, speaker 230 is coupled to system controller 220 (e.g., using wires or wirelessly). Speaker 230 partially extends into enclosure 240. More specifically, rear side 232 of speaker 230 forms enclosed space 242 together with enclosure 240.

Referring to block 350 in FIG. 3, method 300 may proceed with generating audio reducing sound 231 in target space 290, which comprises enclosed space 242. Audio reducing sound 231 is generated using speaker 230 and based on speaker signal 221.

Referring to block 360 in FIG. 3, method 300 may proceed with reducing amplitude of audio reducing sound 231 in selected frequency range using resonator 250. This process may be also referred to as muting and is performed by resonator 250. Resonator 250 in fluid communication with enclosed space 242.

In some embodiments, resonator 250 comprises interior space 252, which is in fluid communication with enclosed space 242. Compressibility of the air in interior space 252 is used for this operation. For example, some air may flow between interior space 252 of resonator 250 and enclosed space 242.

Referring to block 365 in FIG. 3, method 300 may further comprise amplitude of audio reducing sound 231 in additional selected frequency range using additional resonator 255. Additional resonator 280 is also in fluid communication with enclosed space 242. The additional selected frequency range is different from selected frequency range.

Referring to block 370 in FIG. 3, method 300 may further comprising changing selected frequency range by changing one of more characteristics of resonator (block 375 in FIG. 3). Changing one of more characteristics of resonator 250 comprises changing volume of interior space 252 of resonator 250 or changing area of opening to interior space 252 of resonator 250.

Performance Characteristics

Figure 4A:
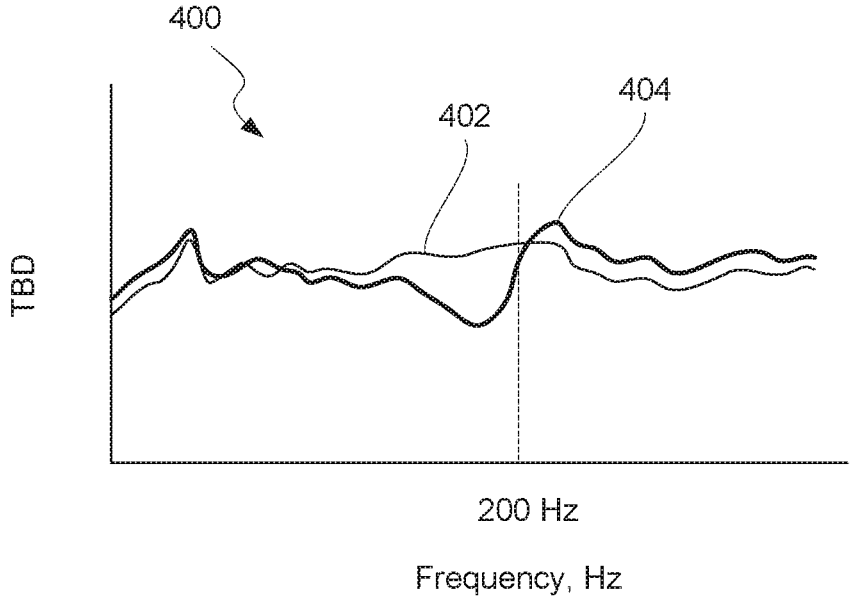
FIGS. 4A and 4B illustrate gain plots and phase plot of the transfer function for a system without a Helmholtz resonator and also for a system equipped with a Helmholtz resonator.
Figure 4B:
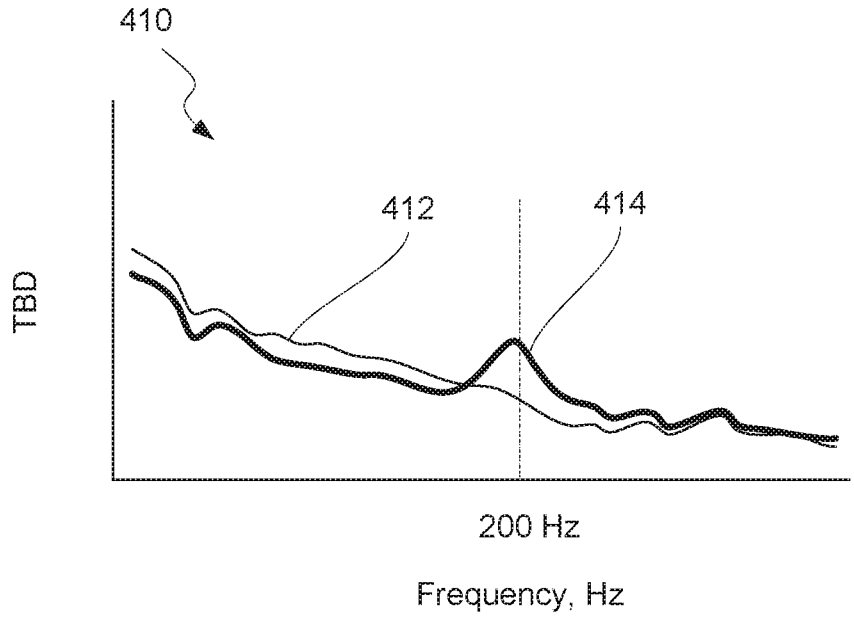

Various performance characteristics of system 200, described above, will now be discussed. FIGS. 4A and 4B illustrate the resulting gain plots 400 and phase plot 410 of the transfer function from the speaker to the microphone for a system without a Helmholtz resonator (lines 402 and 412) and for a system equipped with a Helmholtz resonator (lines 404 and 414). Lines 402 and 412 may be referred to as baselines or reference lines. Line 414 clearly displays 30 degrees of additional phase at 200 Hz. This effect may be similar to that of a lead-lag control circuit, but is achieved using the Helmholtz resonator rather than signal processing. The frequency where this additional phase occurs is related to the neck length, the area of the neck opening, and the volume of the Helmholtz resonator. The amount of phase is determined by the volume of the Helmholtz resonator with a bigger resonator producing more phase. This additional dynamic in the speaker can be designed to reduce unwanted amplification in a feedback control loop.

Figure 5A:
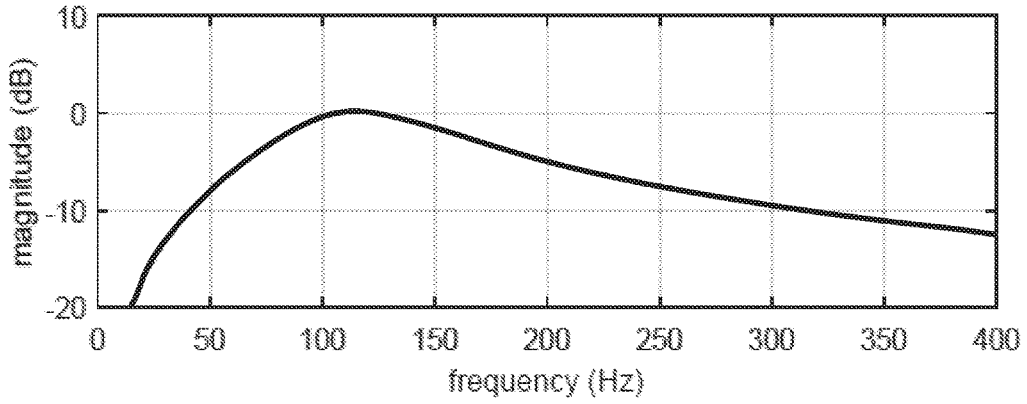
FIGS. 5A and 5B are plots of the transfer function for a model of the speaker with resonance around 100 Hz, a model of the amplifier as a high pass filter with a cutoff frequency of 5 Hz and a selectable delay to represent the propagation delay between the speaker and the microphone.
Figure 5B:
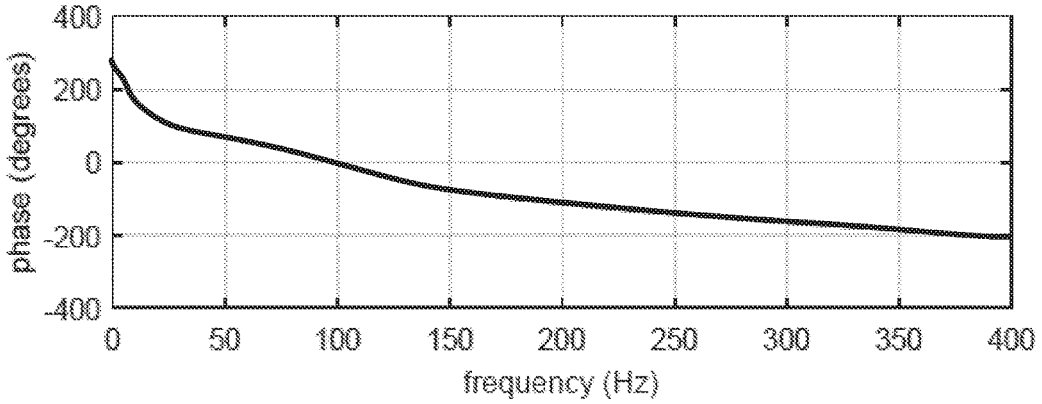

To understand the impact of this selectable phase increase, a mathematical model was formulated that included a model of the speaker with resonance around 100 Hz, a model of the amplifier as a high pass filter with a cutoff frequency of 5 Hz and a selectable delay to represent the propagation delay between the control speaker and the microphone. The transfer function of the model is shown in FIGS. 5A and 5B. This transfer function relates the voltage into the speaker to the pressure generated at the feedback microphone.

Figure 5C:
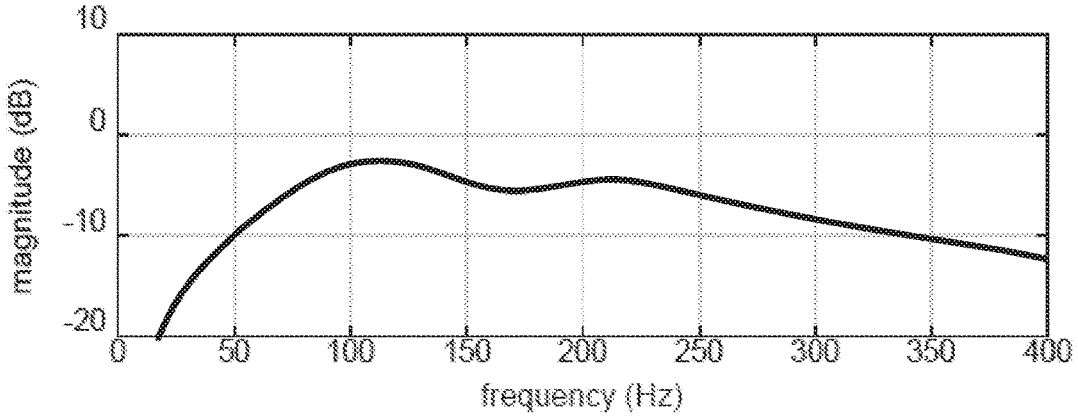
FIGS. 5C and 5D are plots of the transfer function for a model of the speaker with resonance around 100 Hz, a model of the amplifier as a high pass filter with a cutoff frequency of 5 Hz, a selectable delay to represent the propagation delay between the speaker and the microphone, and a Helmholtz resonator.
Figure 5D:
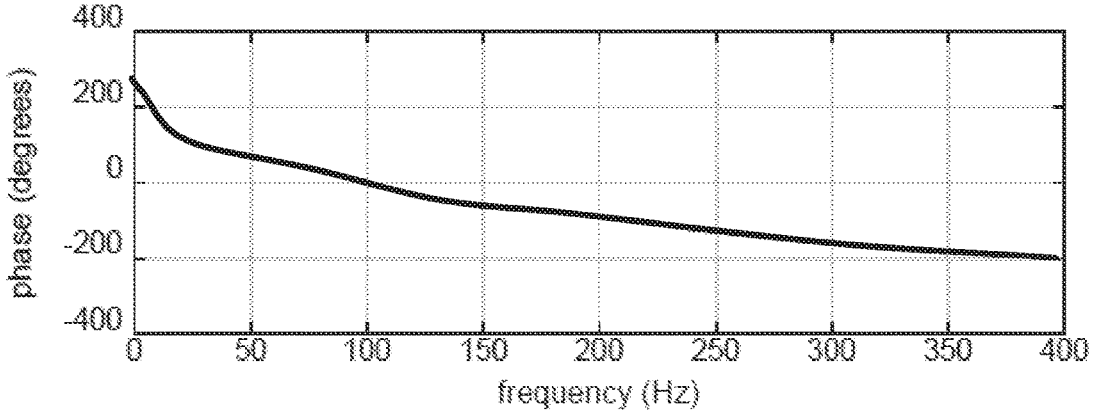

For comparison, the transfer function of the model with the Helmholtz resonator is shown in FIGS. 5C and 5D. At around 200 Hz, the phase is increased by the addition of a zero-pole pair as is shown experimentally in FIGS. 4A and 4B. This added dynamic modifies the gain and phase relationship in a way that can be designed using the properties of the resonator. This modification can be used to decrease unwanted amplification as shown for example in FIG. 1B.

Applying the same feedback control as described above and illustrated in FIG. 1B and FIG. 6A illustrates a similar decrease in response below 125 Hz and increase in response above that frequency. In this case, the amplification is more pronounced and the transition frequency is lower, but the phenomenon is identical. This behavior is typical of feedback control systems with excessive delay. The lower transition frequency physically might correspond to a larger distance between the feedback speaker and microphone or a computational delay in the system.

Figures 7A, 7B:
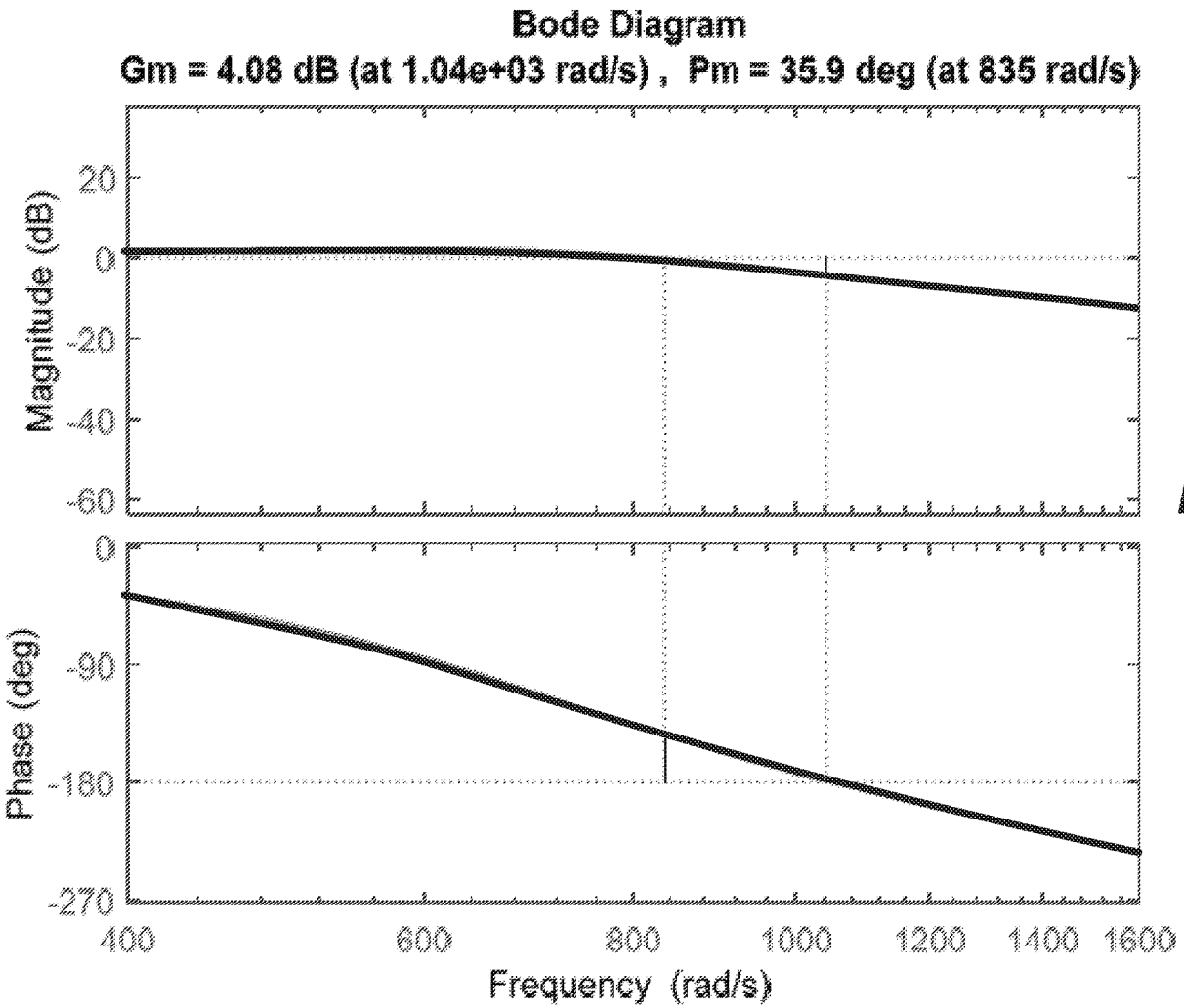
FIGS. 7A and 7B show the open-loop transfer function before adding the Helmholtz resonator.
Figures 7C, 7D:
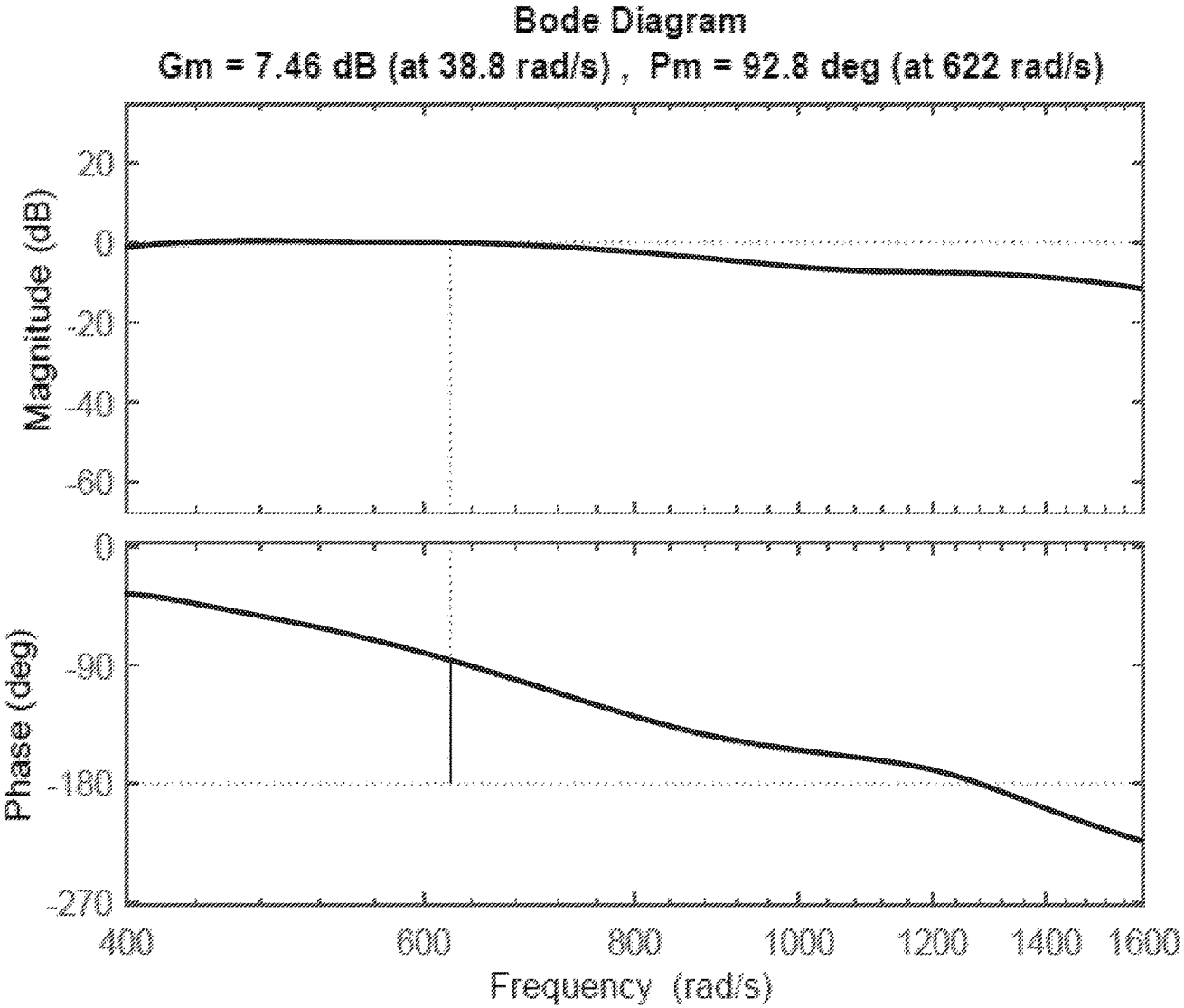
FIGS. 7C and 7D show the same function after adding the Helmholtz resonator.

In order to reduce the amplification of a traditional feedback control system, the next step would be to look at the gain and phase margins in the open-loop transfer function. This was done for the acoustic compensator and the frequency of the Helmholtz resonator was varied until the gain and phase margins were maximized. The starting point for the frequency selected was the 0 dB point on the open-loop transfer function or crossover frequency. Improved performance was observed when the frequency was adjusted to approximately 1.5 times the crossover frequency. FIGS. 7A and 7B show the open-loop transfer function before adding the Helmholtz resonator. FIGS. 7C and 7D show the same function after adding the Helmholtz resonator. The gain margin and phase margin without the Helmholtz resonator are 4 dB and 36 degrees respectively. With the Helmholtz resonator, these move to 7 dB and 93 degrees respectively.

Figure 6A:
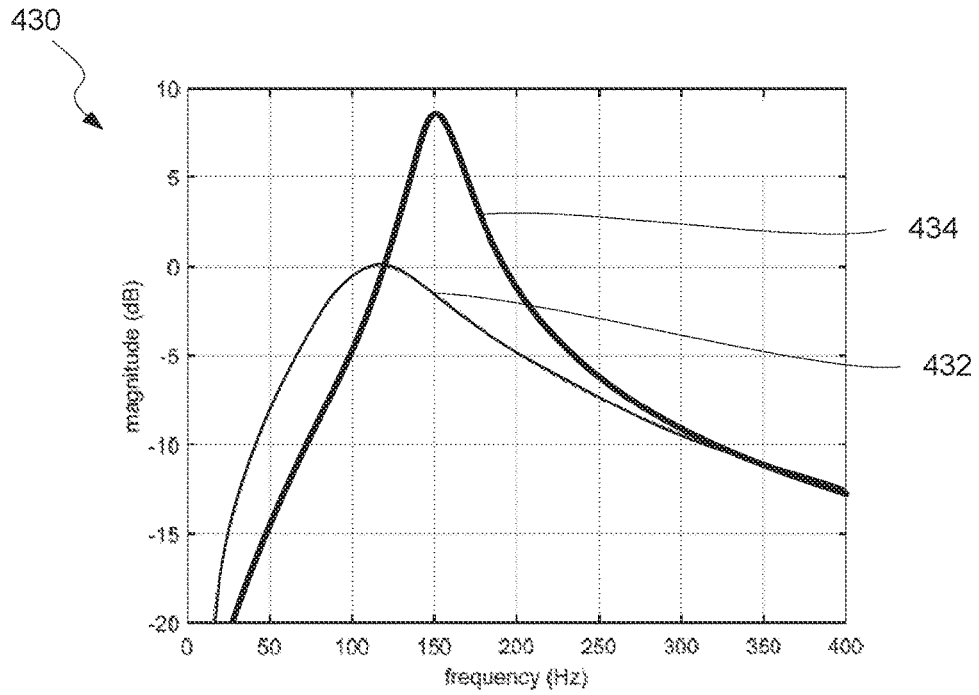
FIG. 6A is a plot of transfer functions of a system without a resonator.
Figure 6B:
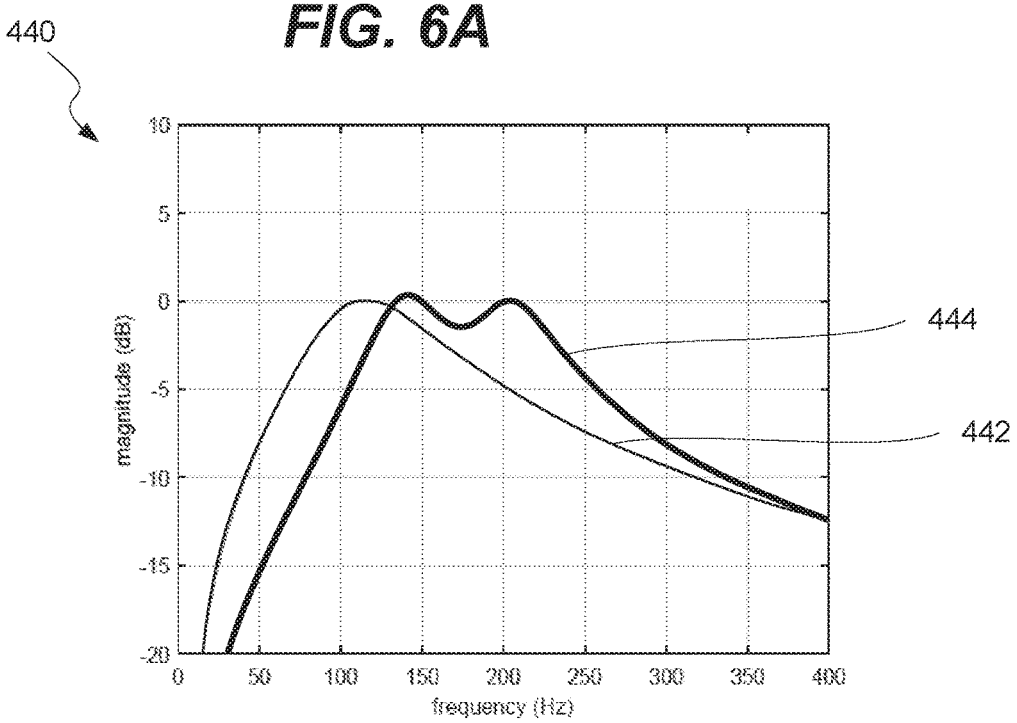
FIG. 6B is a plot of transfer functions of a system with a Helmholtz resonator.

FIG. 6B illustrates a closed loop behavior of the acoustic feedback system with the Helmholtz resonator (in comparison to FIG. 6A, which is a similar system but without the Helmholtz resonator). Introducing the resonator lowers the unwanted peak sound amplification at 150 Hz by 8 dB which would correspond to lowering the sound pressure by more than a factor of two.

Figure 8:
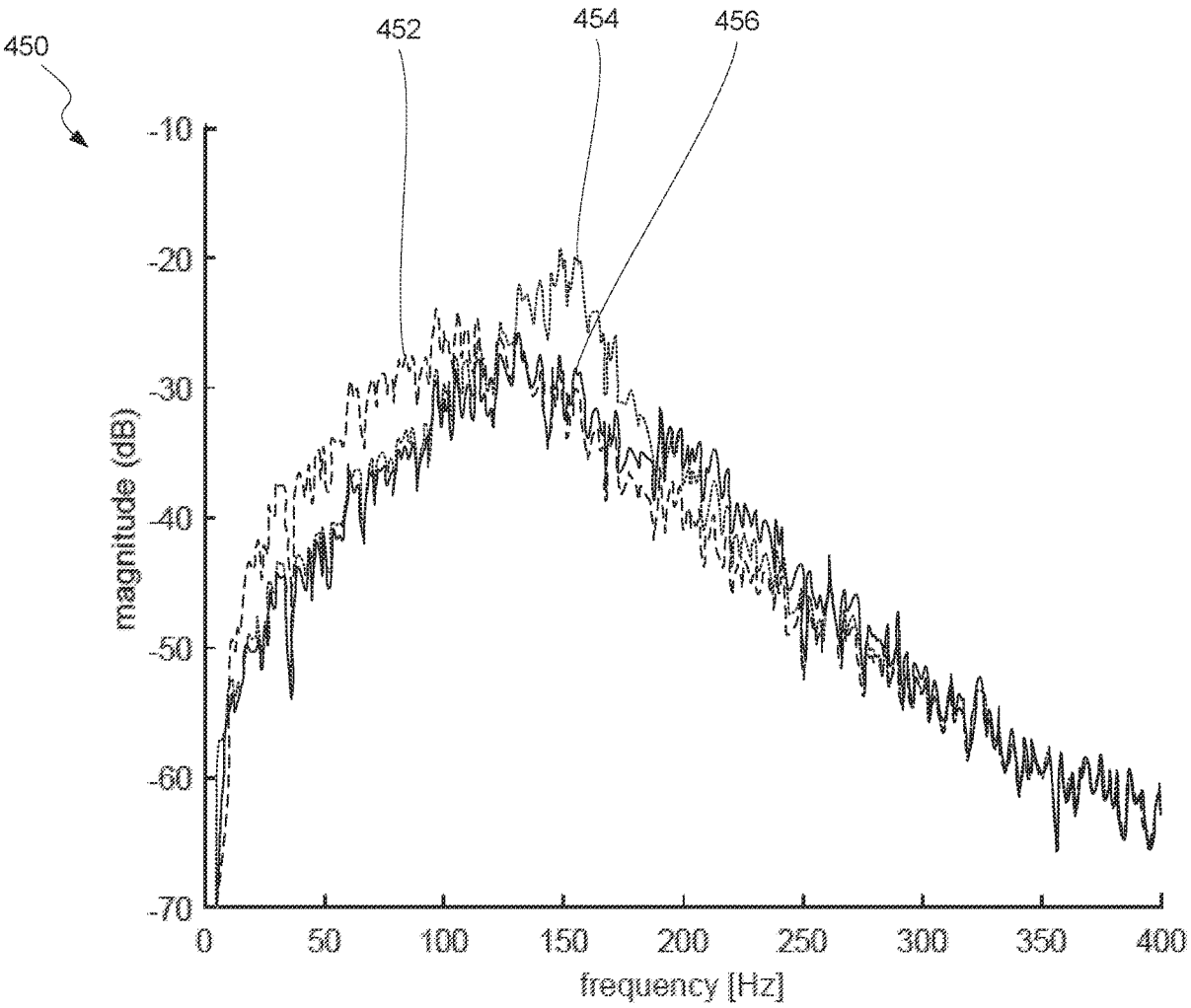
FIG. 8 illustrates expected performance of a system without control feedback, with control feedback, and with both controlled feedback and Helmholtz resonator.

FIG. 8 shows plot 450 of three expected performances, line 452 representing the control system being turned off, line 454 representing the control system being turned on but operating without a Helmholtz resonator, and line 456 representing the control system being turned on and operating with a Helmholtz resonator. The input, in each case, is shaped random noise with relatively large low frequency noise and relatively low high frequency noise.

Examples of Aircraft

An aircraft manufacturing and service method 600 shown in FIG. 9 and an aircraft 630 shown in FIG. 10 will now be described to better illustrate various features of processes and systems presented herein. During pre-production, aircraft manufacturing and service method 600 may include specification and design 602 of aircraft 630 and material procurement 604. The production phase involves component and subassembly manufacturing 606 and system integration 608 of aircraft 630. Thereafter, aircraft 630 may go through certification and delivery 610 to be placed in service 612. While in service by a customer, aircraft 630 is scheduled for routine maintenance and service 614 (which may also include modification, reconfiguration, refurbishment, and so on). While the embodiments described herein relate generally to servicing of commercial aircraft, they may be practiced at other stages of the aircraft manufacturing and service method 600.

Each of the processes of aircraft manufacturing and service method 600 may be performed or carried out by a system integrator, a third party, and/or an operator (e.g., a customer). For the purposes of this description, a system integrator may include, without limitation, any number of aircraft manufacturers and major-system subcontractors; a third party may include, for example, without limitation, any number of vendors, subcontractors, and suppliers; and an operator may be an airline, leasing company, military entity, service organization, and so on.

Figure 9:
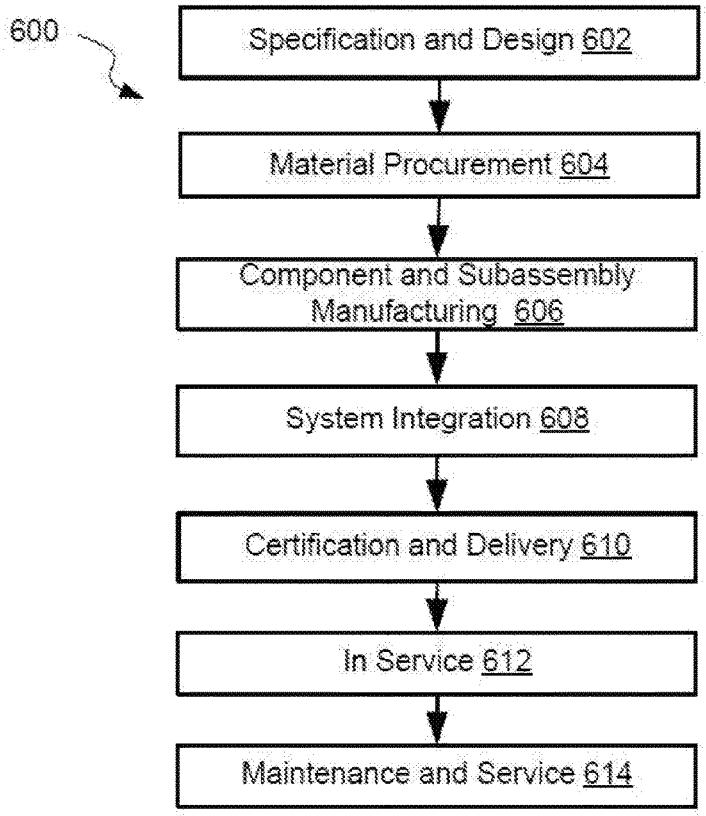
FIG. 9 is a process flowchart reflecting key operations in the life cycle of an aircraft from the early stages of manufacturing to entering service, in accordance with some embodiments.
Figure 10:
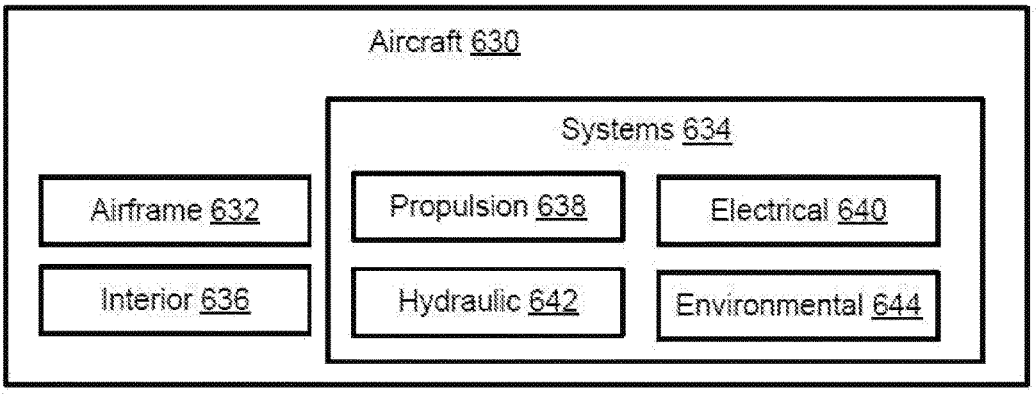
FIG. 10 is a block diagram illustrating various components of an aircraft, in accordance with some embodiments.

As shown in FIG. 9, aircraft 630 produced by aircraft manufacturing and service method 600 may include airframe 632, interior 636, and multiple systems 634 and interior 636. Examples of systems 634 include one or more of propulsion system 638, electrical system 640, hydraulic system 642, and environmental system 644. Any number of other systems may be included in this example. Although an aircraft example is shown, the principles of the disclosure may be applied to other industries, such as the automotive industry.

Apparatus and methods embodied herein may be employed during any one or more of the stages of aircraft manufacturing and service method 600. For example, without limitation, components or subassemblies corresponding to component and subassembly manufacturing 606 may be fabricated or manufactured in a manner like components or subassemblies produced while aircraft 630 is in service.

Also, one or more apparatus embodiments, method embodiments, or a combination thereof may be utilized during component and subassembly manufacturing 606 and system integration 608, for example, without limitation, by substantially expediting assembly of or reducing the cost of aircraft 630. Similarly, one or more of apparatus embodiments, method embodiments, or a combination thereof may be utilized while aircraft 630 is in service, for example, without limitation, to maintenance and service 614 may be used during system integration 608 and/or maintenance and service 614 to determine whether parts may be connected and/or mated to each other.

Examples of Controller Computer Systems

Figure 11:
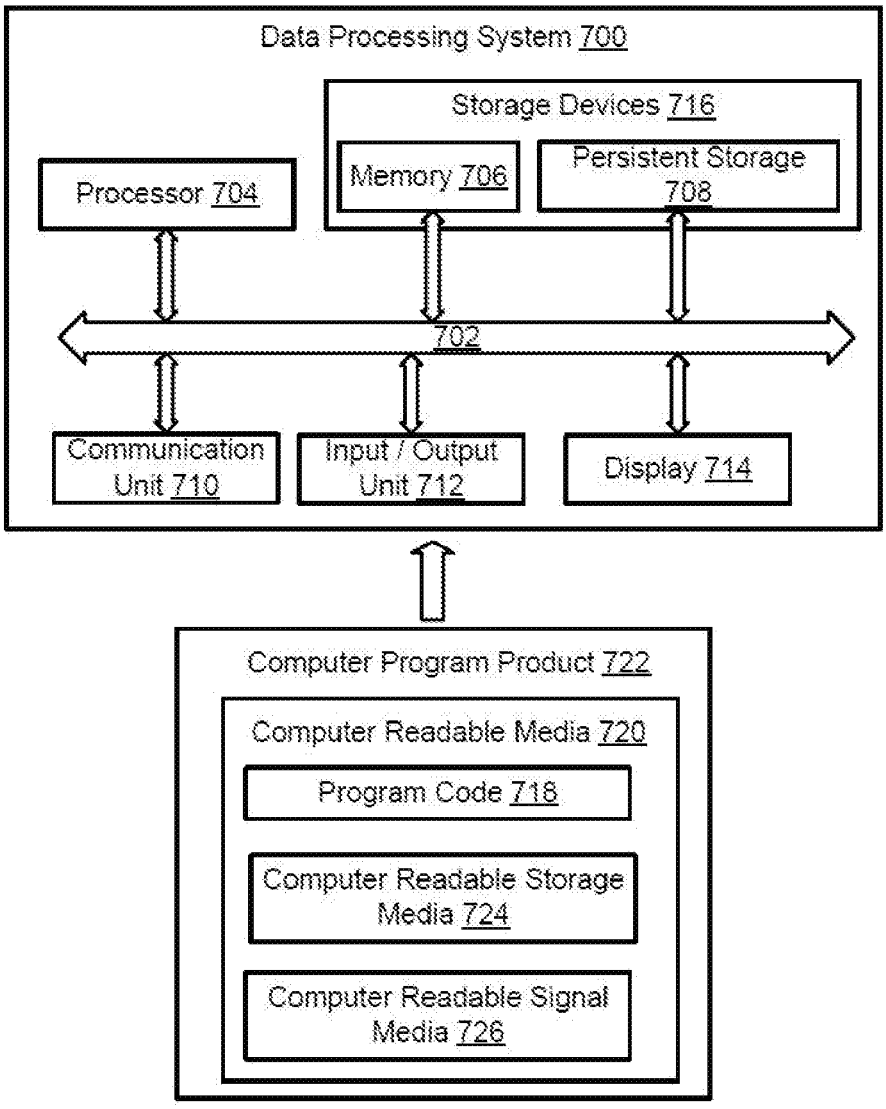
FIG. 11 is a block diagram illustrating a data processing system, in accordance with some embodiments.

Turning now to FIG. 11, an illustration of a data processing system 700 is depicted in accordance with some embodiments. Data processing system 700 may be used to implement one or more computers used in a controller or other components of various systems described above. In some embodiments, data processing system 700 includes communications framework 702, which provides communications between processor unit 704, memory 706, persistent storage 708, communications unit 710, input/output (I/O) unit 712, and display 714. In this example, communications framework 702 may take the form of a bus system. Data processing system 700 may be used to execute one or more operations of method 300 described above, in particular analyzing data feedbacks to determine presence of objects in their respective inspection zones and/or identification of these objects.

Processor unit 704 serves to execute instructions for software that may be loaded into memory 706. Processor unit 704 may be a number of processors, a multi-processor core, or some other type of processor, depending on the particular implementation.

Memory 706 and persistent storage 708 are examples of storage devices 716. A storage device is any piece of hardware that is capable of storing information, such as, for example, without limitation, data, program code in functional form, and/or other suitable information either on a temporary basis and/or a permanent basis. Storage devices 716 may also be referred to as computer readable storage devices in these illustrative examples. Memory 706, in these examples, may be, for example, a random-access memory or any other suitable volatile or non-volatile storage device. Persistent storage 708 may take various forms, depending on the particular implementation. For example, persistent storage 708 may contain one or more components or devices. For example, persistent storage 708 may be a hard drive, a flash memory, a rewritable optical disk, a rewritable magnetic tape, or some combination of the above. The media used by persistent storage 708 also may be removable. For example, a removable hard drive may be used for persistent storage 708.

Communications unit 710, in these illustrative examples, provides for communications with other data processing systems or devices. In these illustrative examples, communications unit 710 is a network interface card.

Input/output unit 712 allows for input and output of data with other devices that may be connected to data processing system 700. For example, input/output unit 712 may provide a connection for user input through a keyboard, a mouse, and/or some other suitable input device. Further, input/output unit 712 may send output to a printer. Display 714 provides a mechanism to display information to a user.

Instructions for the operating system, applications, and/or programs may be located in storage devices 716, which are in communication with processor unit 704 through communications framework 702. The processes of the different embodiments may be performed by processor unit 704 using computer-implemented instructions, which may be located in a memory, such as memory 706.

These instructions are referred to as program code, computer usable program code, or computer readable program code that may be read and executed by a processor in processor unit 704. The program code in the different embodiments may be embodied on different physical or computer readable storage media, such as memory 706 or persistent storage 708.

Program code 718 is located in a functional form on computer readable media 720 that is selectively removable and may be loaded onto or transmitted to data processing system 700 for execution by processor unit 704. Program code 718 and computer readable media 720 form computer program product 722 in these illustrative examples. In one example, computer readable media 720 may be computer readable storage media 724 or computer readable signal media 726.

In these illustrative examples, computer readable storage media 724 is a physical or tangible storage device used to store program code 718 rather than a medium that propagates or transmits program code 718.

Alternatively, program code 718 may be transmitted to data processing system 700 using computer readable signal media 726. Computer readable signal media 726 may be, for example, a propagated data signal containing program code 718. For example, computer readable signal media 726 may be an electromagnetic signal, an optical signal, and/or any other suitable type of signal. These signals may be transmitted over communications channels, such as wireless communications channels, optical fiber cable, coaxial cable, a wire, and/or any other suitable type of communications channel.

The different components illustrated for data processing system 700 are not meant to provide architectural limitations to the manner in which different embodiments may be implemented. The different illustrative embodiments may be implemented in a data processing system including components in addition to and/or in place of those illustrated for data processing system 700. Other components shown in FIG. 11 can be varied from the illustrative examples shown. The different embodiments may be implemented using any hardware device or system capable of running program code 718.

CONCLUSION

Although foregoing concepts have been described in some detail for purposes of clarity of understanding, it will be apparent that certain changes and modifications may be practiced within scope of appended claims. It should be noted that there are many alternative ways of implementing processes, systems, and apparatuses. Accordingly, present embodiments are to be considered as illustrative and not restrictive.

The invention claimed is:

1. A method for broad-band reduction of noise in a target space, the method comprising:

generating a microphone signal, wherein the microphone signal represents the noise in the target space and is generated using a feedback microphone;

transmitting the microphone signal to a system controller;

generating a speaker signal based on the microphone signal, wherein the speaker signal is generated using the system controller;

transmitting the speaker signal to a speaker, wherein the speaker partially extends into an enclosure, and wherein a rear side of the speaker forms an enclosed space together with the enclosure;

generating an audio reducing sound in the target space, wherein the audio reducing sound is generated using the speaker and based on the speaker signal; and reducing amplitude of unwanted amplification in a selected frequency range using a resonator, wherein the unwanted amplification is a result of the audio reducing sound generated by the speaker and captured by the feedback microphone, wherein the selected frequency range is determined at least in part by a distance between the speaker and the feedback microphone, and wherein the resonator is specifically configured to reduce the unwanted amplification in the selected frequency range and in fluid communication with the enclosed space.

2. The method of claim 1, wherein, while reducing the amplitude of the audio reducing sound, air flows between the resonator and the enclosed space.

3. The method of claim 1, wherein the resonator at least partially extends into the enclosed space.

4. The method of claim 1, wherein the resonator comprises a neck, extending into the enclosed space.

5. The method of claim 1, wherein the resonator is selected from the group consisting of a Helmholtz resonator, a passive radiator, a quarter wave resonator, a pipe resonator, and an acoustic metamaterial.

6. The method of claim 1, wherein the selected frequency range, in which the amplitude of the unwanted amplification is being reduced using the resonator, is above 100 Hz.

7. The method of claim 1, further comprising reducing the amplitude of the audio reducing sound in an additional selected frequency range using an additional resonator, wherein the additional resonator in fluid communication with the enclosed space, wherein the additional selected frequency range is different from the selected frequency range.

8. The method of claim 1, further comprising changing the selected frequency range by changing one of more characteristics of the resonator.

9. The method of claim 8, wherein changing the one of more characteristics of the resonator comprises changing a volume of an interior space of the resonator or changing an area of an opening to the interior space of the resonator.

10. The method of claim 1, wherein:

the target space is an area surrounding a headrest of a passenger seat in an aircraft; and the feedback microphone, the speaker, and the enclosure are disposed in a headrest of the passenger seat.

11. A system for broad-band reduction of noise in a target space, the system comprising:

a feedback microphone, configured to generate a microphone signal representing the noise in the target space;

a system controller, coupled to the feedback microphone, configured to receive the microphone signal representing from the feedback microphone and configured to generate a speaker signal based on the microphone signal;

a speaker, comprising a rear side and configured to generate an audio reducing sound in the target space based on the speaker signal;

an enclosure, wherein the speaker partially extends into the enclosure, and wherein the rear side of the speaker forms an enclosed space together with the enclosure; and a resonator, in fluid communication with the enclosed space, wherein the resonator is specifically configured to reduce amplitude of unwanted amplification of the audio reducing sound in a selected frequency range, wherein the unwanted amplification is a result of the audio reducing sound generated by the speaker and captured by the feedback microphone, and wherein the selected frequency range is determined at least in part by a distance between the speaker and the feedback microphone.

12. The system of claim 11, wherein the resonator is selected from the group consisting of a Helmholtz resonator, a passive radiator, a quarter wave resonator, a pipe resonator, and an acoustic metamaterial.

13. The system of claim 11, wherein the resonator at least partially extends into the enclosed space.

14. The system of claim 11, wherein the resonator comprises a neck, extending into the enclosed space.

15. The system of claim 11, wherein the resonator is fully within the enclosed space.

16. The system of claim 11, wherein the resonator is a part of the enclosure.

17. The system of claim 11, wherein the resonator comprises an interior space, comprising an opening, wherein a volume of the interior space or an area of the opening to the interior space of the resonator is controllably adjustable.

18. The system of claim 11, further comprising an additional resonator, in fluid communication with the enclosed space, wherein the additional resonator is configured to reduce the amplitude of the audio reducing sound in an additional selected frequency range, different from the selected frequency range.

19. The system of claim 11, further comprising a headrest for use in a passenger seat of an aircraft, wherein the feedback microphone, the speaker, and the enclosure are disposed in the headrest of the passenger seat.

20. An aircraft comprising:

a passenger seat, comprising a headrest; and a system, comprising:

a feedback microphone, configured to generate a microphone signal representing noise in a target space;

a system controller, coupled to the feedback microphone, configured to receive the microphone signal representing from the feedback microphone and configured to generate a speaker signal based on the microphone signal;

a speaker, comprising a rear side and configured to generate an audio reducing sound in the target space based on the speaker signal;

an enclosure, wherein the speaker partially extends into the enclosure, and wherein the rear side of the speaker forms an enclosed space together with the enclosure; and a resonator, in fluid communication with the enclosed space, wherein the resonator is specifically configured to reduce amplitude of unwanted amplification of the audio reducing sound in a selected frequency range, wherein the unwanted amplification is a result of the audio reducing sound generated by the speaker and captured by the feedback microphone, wherein the selected frequency range is determined at least in part by a distance between the speaker and the feedback microphone, and wherein the feedback microphone, the speaker, and the enclosure are disposed in the headrest of the passenger seat.

* * * * *